United States Patent [19]

Napolitano

[11] Patent Number: 5,036,685

[45] Date of Patent: Aug. 6, 1991

[54] DOOR SECURITY APPARATUS

[76] Inventor: Rudolph Napolitano, 2150 NE. 172nd St., North Miami Beach, Fla. 33162

[21] Appl. No.: 594,551

[22] Filed: Oct. 9, 1990

[51] Int. Cl.[5] ..... B65D 55/14

[52] U.S. Cl. ..... 70/161; 70/94; 292/238

[58] Field of Search ..... 70/135, 139, 154, 161, 70/94, 159, 160; 292/304, 259, 230, 238

[56] References Cited

U.S. PATENT DOCUMENTS

| | | | |
|---|---|---|---|
| 404,038 | 5/1889 | Hansberry | 292/238 |
| 3,665,736 | 5/1972 | Wilson | 292/259 R |
| 4,796,445 | 1/1989 | Norden | 292/259 R |

*Primary Examiner*—Robert L. Wolfe

*Attorney, Agent, or Firm*—Robert J. Van Der Wall

[57] ABSTRACT

Provided is an apparatus for use for a pivotally mounted door disposed in a wall and usually mounted within a door frame. Pivotal mounting of the door is on a hinge. The security apparatus is mounted to a door frame or wall above the door by any suitable technique and is comprised principally of two main body portions in the form of a fixed clamshell and a pivoting clamshell connected by a piano hinge. These clamshell portions enclose a few operative portions of the structure including a locking mechanism preferably comprised of a pivoting key operated lock, a pivoting lock dog, a lock dog lip and a door strike plate. The fixed clamshell is attached to the wall or door frame top by apparatus that may include large size screws or bolts, or the device may be welded thereto as desired. The attaching means is contained within the clamshell enclosure to prevent tampering therewith. The clamshell portions are formed of plates and ends to totally enclose at all times operative portions of the apparatus. Also included is a door strike plate, which is a U-shaped structure attached to the exterior of the door in proximity to the pivoting clamshell portion. Attachment is by conventional techniques including screws or bolts or by welding to the exterior of a metal door since access to the fastening apparatus is also denied the unauthorized intruder when the pivoting clamshell is locked to prevent access.

26 Claims, 1 Drawing Sheet

J. JONES

DOOR SECURITY APPARATUS

FIELD OF THE INVENTION

The present invention relates to the field of security apparatus intended for use with hinge mounted doors, and, more particularly, to a device that is inherently tamper resistant, is externally operable and adds door drip cap, decorative, informational and easily installed features to its security function. It is specifically designed, but not limited to, use with warehouse and self storage facility metal doors where external visibility and operability are of extreme importance.

BACKGROUND OF THE INVENTION

Ever since the development of enclosed storage facilities for the safe keeping of personal property and valuables, the means of preventing unauthorized entry has been of paramount importance. One difficulty with conventional locked doors is that they normally apply resistance to unauthorized entry at a single point, such as the dead bolt entry into the door frame in a conventional key operated lock. Regardless of the single point of resistance issue, whether or not a storage facility lock has been tampered with is not always readily discernible from the exterior without a close up inspection or the physical effort to open the door to it. There has, therefore, been a need for an externally operable device which readily indicates without close inspection whether or not the enclosure or storage facility is sealed against unauthorized entry. Moreover, there is an inherent advantage to a self enclosed security device which accomplishes the foregoing advantages without unsightly components that are subject to tampering, cumbersome to remove and store during authorized access, subject to being lost necessitating storage when the security device is not activated, and the like. It is even a further advantage to have a security device which provides linear, rather than point or multiple point, resistance to unauthorized entry particularly in the case of a hinged door which normally includes a dead bolt single point of resistance in combination with two or more hinges at discreet points, either of which provides substantially more vulnerability to unauthorized entry than does the present invention.

Since a principal use of the present invention is directed to self storage facilities, the present invention can be employed either by the renter of storage space, or by the landlord thereof or both. The inventive apparatus would provide security for stored goods in the first instance, and readily demonstrate to security guards that the apparatus was locked, without close inspection. However, if the renter failed to pay rent in a timely manner, the landlord could change the lock on the inventive apparatus without entering or changing the conventional door lock. The renter would thereafter have to pay back rent to enter the storage facility even though satisfied that there had been no entry by the landlord who would not need a key to the renter's lock.

Various inventive efforts have been directed to devices preventing the opening of doors by unauthorized persons. A preexamination search has revealed various patented devices directed to door security. Most of these concern internally operable apparatus such as would be applicable to the door to a dwelling operable by an occupant thereof.

The first of these references is Norden, Jr., U.S. Pat. No. 4,796,445, concerning a door locking mechanism.

This device utilizes an expandable bar attached to the interior of a door and includes rotating ends of the bar, that are substantially rectangular. Each of these ends are held in a secure position by padlocks, the device itself is attached to the door by bolts, and each of the rotating ends disposes a handle for rotation thereof. Since the device disclosed and claimed by Norden, Jr., is inside, it cannot be seen and is not operable externally. Unlocking is accomplished by padlocks, a cumbersome procedure at best. Since the device must be interiorly operated, it represents a substantial departure from the means and structure of the present invention where external operability and visibility are paramount. The device does not present particularly easy installation, provides no drip cap or informational feature, or decorative aspect and generally fails to meet the objectives of the present invention as set forth hereinafter.

A further such reference is Lack, U.S. Pat. No. 4,671,014, which uses a bar pivoted on a hinge pin with a hook at the other end to cooperate lockingly with a hoop type hasp pivotally attached to the door frame opposing the door frame opposite the hinges. This device also is an inside device which cannot be seen externally to determine whether or not access is authorized or the device has been tampered with, the device must be interiorly operated, the invention represents no decorative or informational aspect or includes any structure that can be utilized as a drip cap, and also therefore fails to meet the objectives of the present invention as hereinafter set forth.

A further interesting reference disclosed by the search is Knierim, U.S. Pat. No. 4,348,879. This reference discloses a device intended to permit limited opening of a door in a manner similar to that provided by a security chain. That is, the invention is intended to permit the occupant of a dwelling to open a door a limited amount such as to determine whether or not to permit the potential entrant access. This is accomplished with an apparatus recessed into the floor adjoining the door and requires the user to bend down to open a locking device and move a slide member which in turn operates a linkage which buckles a hinge member into the path of the door. It is intended for use inside of a dwelling for an inside opening door, and when so used, it is an inside device that cannot be externally operated, nor is it visible externally to determine whether it has been tampered with or whether access is authorized. Although not so intended, the device could be used externally with an outside opening door, and if so, the device would still fail to meet the objectives of the present invention, having no drip cap or decorative or informational feature. Furthermore, installation would not be easy, and if used externally, the device would probably be relatively easy to remove from the floor. In the latter event, the device would not demonstrate whether access was permitted without relatively close inspection. Thus, even if used externally, the structure of this linkage type device fails to meet the objectives of the present invention.

One more reference is Miller, U.S. Pat. No. 3,897,965, which discloses a door plate that cooperates with a door knob. The door plate includes a lock member extending perpendicularly from the plate and having a serrated edge, which cooperates lockingly with a rotable pin attached indirectly to the door frame. That is, the serrated arm engages the pin to achieve the locking function. However, again the disclosed apparatus is an inside device which cannot be seen to determine whether access is authorized, it must be internally operated, it lacks the drip cap, informational, and decorative aspect functions, and does not appear very simple to install. The means for attachment to the door knob, for example, is vague.

A final internally operable device is that disclosed and claimed by Kemp, U.S. Pat. No. 1,701,076, which teaches a lever operated sliding and pivoting mechanism that activates a plurality of dead bolt type devices that cooperate respectively with a frame mounted strike plate, and a plurality of floor recesses. The disclosed apparatus is obviously expensive to manufacture, difficult to install, and still lacks an external visibility or operability, the absence of a drip cap, and the absence of any informational or decorative feature.

The only reference disclosed by Applicant's preexamination search expressly teaching external visibility and operability was a security bar as disclosed and claimed by Richards, Sr., in U.S. Pat. No. 3,815,389. This device is principally disclosed as a key operated locking mechanism for locking filing cabinets, chests, and the like, but which also could be applied to outwardly swinging hinged doors. Particular reference to FIG. 3 is indicated, and although said figure discloses a double door cabinet, it is clear that the device is applicable to externally operable, externally swinging single doors. This disclosure teaches attachment to the frame using only two pins, making tamper resistance questionable at best. More importantly, the disclosure indicates that the device becomes a loose piece when access is authorized, requiring storage of the same and subjecting the apparatus to theft or misplacement. Unsightlyness is inherent, the device is cumbersome to operate, it provides no decorative aspect, and certainly provides no drip cap or informational functions, thereby failing most of the objective of the present invention even though it does include external visibility and operability.

In summary, none of the references disclosed by the preexamination search meets the objects and advantages hereinafter set forth of the present invention, and certainly none of them disclosed any physical structure or apparatus that anticipate or suggest the structure utilized to accomplish the objectives of the present invention, as will be seen hereinafter.

SUMMARY OF THE INVENTION

Bearing in mind the foregoing, it is a principal object of the invention to provide a door security apparatus intended for use with storage facilities and other enclosures which device is externally operable.

A related object of the invention is to provide a door security device which is externally visible to indicate readily without close inspection that entry is unauthorized.

A correlated object of the invention is to indicate without close inspection that the security apparatus of the invention has not been subject to tampering.

Another object of the invention is to provide a self contained security device that is especially resistant to tampering.

An additional object of the invention is to provide a door security apparatus which is not cumbersome to operate.

A related object of the invention is to provide a door security device which has no removable parts which must be stored, subject to theft or misplacement, or otherwise interferes with entry and egress from the enclosure being secured by the device.

A further object of the invention is to provide apparatus which shields the upper surface of an external door from rain or other precipitation in the form of a drip cap.

One more object of the invention is to provide a security apparatus which has a decorative aspect having no unsightly components.

An additional object of the invention is to provide a site for informational indicia in the form of color coding, tracks for letters or numbers or the like.

An associated object of the invention is to provide security for self storage facilities that is separable from the conventional security devices with which it may concurrently be employed, so that landlord and tenant have discrete security systems.

A further object of the invention is to provide a door security apparatus which is inexpensive to manufacture, easy to install, has a minimum of moving parts and is therefore easy to maintain, and the like.

A further object of the invention is to provide a device which provides linear, rather than point, or multipoint, resistance to unauthorized access.

Another object of the invention is to provide a door security apparatus whose dimensions are independent of door dimension, a single width being usable for all door widths.

One more object of the invention is to provide a door security device requiring no modification to the door of the enclosure on which the same is attached, thus further facilitating the above-described easy installation.

Other objects and advantages will become apparent to those skilled in the art upon a review of the following descriptions, accompanying drawings, and appended claims.

In accordance with the principal aspect of the invention, there is provided an apparatus for use with an outward opening door mounted in a wall and usually mounted within a door frame. the door is pivotally mounted on a hinge. The security apparatus is mounted to the door frame or wall above the door by any suitable means and is comprised principally of two main body portions in the form of a fixed clamshell and a pivoting clamshell connected by a piano hinge. These clamshell portions enclose a few operative portions of the structure including a locking mechanism preferably comprised of a pivoting key operated lock, a pivoting lock dog, a lock dog lip, and, selectively, a door strike plate. The fixed clamshell is attached to the wall or door frame top by apparatus attaching means which may include large size screws or bolts, or the device may be welded thereto as desired. The attaching means is contained within the clamshell enclosure to prevent tampering therewith. The clamshell portions are formed of plates, and ends to totally enclose at all times operative portions of the apparatus.

The inventive apparatus further comprises a door strike plate, which is a U-shaped structure attached to the exterior of the door in proximity to the pivoting clamshell portion. Attachment may be by any conventional means as screws or bolts, or by welding to the exterior of a metal door, since access to the fastening means is also denied the unauthorized intruder when the pivoting clamshell is locked to prevent access. The U-shaped door strike plate includes a back which is attached to the door, a base extending perpendicularly to the plane of the door, and a face which is disposed a short distance from the plane of the door and parallel thereto. The door strike face includes an aperture for interaction with a lock dog which serves to positively retain the pivoting clamshell in a locked position preventing opening of the door, and also preventing access to the lock, to the means by which the apparatus is attached to the wall or door frame, to the door strike aperture, or to the lock dog which interacts with the door strike aperture. The door security apparatus includes ends that overlap to insure that access is denied to the interior of the apparatus to further resist tampering therewith.

A better understanding of the present invention will result from a review of the following detailed description of the apparatus, and appended claims taken in conjunction with the accompanying drawings in which:

DETAILED DESCRIPTION OF PREFERRED EMBODIMENT

Figures 1, 2, 3, 4, 5, 6, 7:
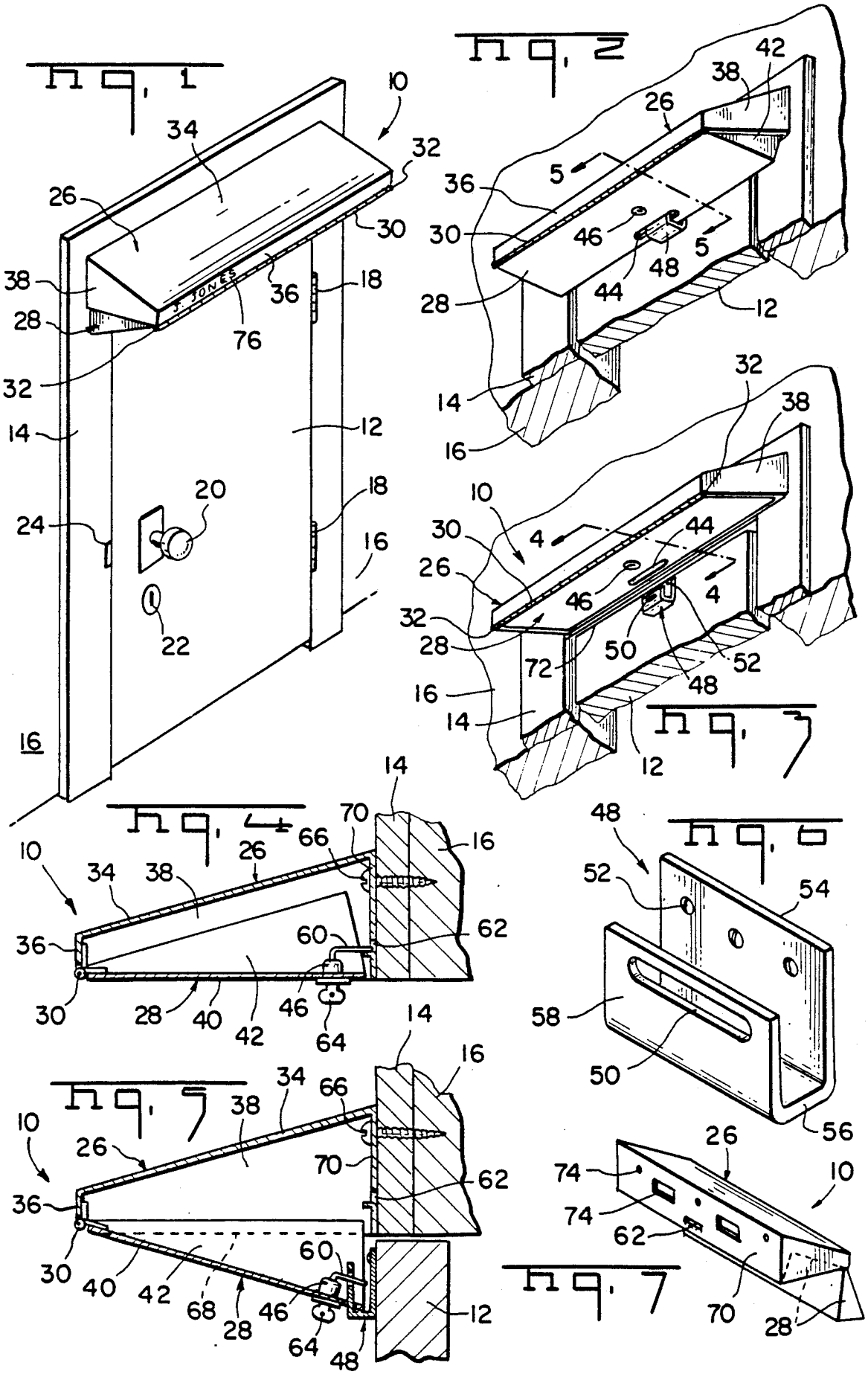
FIG. 1 is a left side perspective view looking from above at the inventive door security apparatus mounted on a door frame in which the apparatus is disposed in its locked position.
FIG. 2 is a right side perspective view looking from below, also showing the apparatus in its locked position, with the environment surrounding the inventive apparatus broken and in cross-section.
FIG. 3 is the same view as FIG. 2, except that the inventive apparatus is found in its opened position.
FIG. 4 is a cross-section view of the inventive apparatus shown along the line 4—4 of FIG. 3.
FIG. 5 is a cross-section view shown along the line 5—5 of FIG. 2.
FIG. 6 is an enlarged right side perspective view of the door strike plate of FIG. 3.
FIG. 7 is a rear perspective view of the door security apparatus.

FIG. 1 discloses the door security apparatus shown generally at 10 mounted above a door 12 and a door frame 14 which disposed within a wall 16. The door is, of course, mounted on door hinges 18. A conventional door knob 20, conventional lock 22, and conventional frame strike plate 24 are also apparent. Of course a padlock and hasp can replace conventional lock 22.

The door security apparatus 10 is generally comprised of a fixed clamshell 26, and pivoting clamshell 28 which are interconnected with a piano hinge 30. The piano hinge 30 is assured against removal from between fixed clamshell 26 and pivoting clamshell 28 by hinge end welds 32.

The dominant structural aspect of the fixed clamshell 26 is the fixed plate 34, which in the mode illustrated forms the upper surface thereof. Further structural aspects are the front 36 and fixed end 38. The fixed end 38 is found at both extremities of the fixed clamshell 26.

FIG. 2 shows the underside of pivoting clamshell 28 attached by piano hinge 30 to the front 36. In this view the other fixed end 38 is visible. Also seen is pivoting end 42, a portion of which is disposed within fixed end 38 resulting in overlap to present interior access. Pivoting clamshell 28 is retained in its locked position by cooperating with door strike plate 48, a portion of which penetrates through pivoting slot 44. Retention is assured against entry by pivoting lock 46.

Turning to FIG. 3, the door security apparatus 10 is shown in the open or authorized entry position in which the pivoting clamshell 28 is shown in the raised or recessed position, thereby exposing the door periphery 72 of door 12 so that the same may be opened outwardly. It is also readily apparent from some distance that entry is authorized became of the disappearance of pivoting clamshell 28 into the interior of fixed clamshell 26. Pivoting clamshell 28 is held or retained in its raised position by means hereinafter described. The raised position exposes fully door strike plate 48 which is attached to door 12 by door strike fastening means 52. Also readily seen is door strike aperture 50 which interacts with pivoting lock 46 by means hereinafter described when pivoting clamshell 28 is in the lowered and locked position as shown in FIG. 2. Also readily apparent with pivoting clamshell 28 in its raised or open position is pivoting slot 44. Of course the movement of pivoting clamshell 28 is accomplished about piano hinge 30, which is retained in position by hinge end welds 32. The construction of door strike plate 48 fully described in regard to FIG. 6.

FIG. 4 is a cross-sectional view taken along the line 4—4 of FIG. 3. It clearly illustrates the construction and operation, when in the open, or authorized access, position of door security apparatus 10, which is the position shown in FIG. 3. The fixed clamshell 26 is shown to be comprised, in the plane of the cross-section 4—4, as fixed plate 34, front 36, and fixed back 70. The latter is shown firmly attached to door frame 14 and wall 16 by apparatus attaching means 66, although welding or other attachment means may be employed at the option of the user. This will be more fully described in connection with FIG. 7 in regard to installation. Fixed end 38 is also visible beyond the plane 4—4. Disposed interiorly of fixed clamshell 26 is pivoting clamshell 28 which is pivotally connected to fixed clamshell 26 by piano hinge 30. Piano hinge 30 is attached to fixed clamshell 26 and pivoting clamshell 28 by any conventional means such as screws or, more preferably, welding. Pivoting plate 40 is shown coincident with the bottom edge of fixed end 38, above which is disposed pivoting end 42. Also visible is pivoting lock 46, key 64, and pivoting lock dog 60 when in the open, or raised authorized entry, position. Pivoting clamshell 28 is retained in that position by the cooperation of pivoting lock dog 60 with lock dog lip 62 which is integral with fixed back 70. Lock dog lip 62 will be seen to be formed as a portion of fixed back 70 in connection with a rear view of door security apparatus 10 when examining installation thereof in FIG. 7. Pivoting lock dog 60 may be activated by any convenient means other than key 64 and pivoting lock 46, including combination locks or the like. These alternative mechanisms are fully contemplated with the invention, but are not illustrated because they are of conventional construction.

Turning to FIG. 5, a cross-sectional view taken along the line 5—5 of FIG. 2 is illustrated. In this view, pivoting clamshell 28 is shown in its lowered, or locked, position with regard to fixed clamshell 26. It will be seen that the extremity of pivoting end 42 raises above, and therefore overlaps at 68, the lower, or dotted edge of fixed end 38, thereby preventing unauthorized access to the interior of door security apparatus 10. Pivoting clamshell 28 is locked into its lowered, or locked, position by the interaction of pivoting lock dog 60 with door strike plate 48 in which is contained a door strike aperture 50 as more fully described in FIG. 6. In this manner, pivoting lock 46 rotates pivoting lock dog 60 into door strike aperture 50 after pivoting clamshell 28 has been lowered in position. Thereafter key 64 can be removed from pivoting lock 46. Further, because of the self enclosing nature of door security apparatus 10, specifically as a consequence of fixed plate 34, front 36, fixed end 38, pivoting end 40, piano hinge 30, hinge end welds 32 (seen in other views), and pivoting end 42 in the end overlap 68 with fixed end 38, access to pivoting lock dog 60 and door strike plate 48 with the door strike aperture 50 cooperating with pivoting lock dog 60 is completely isolated from access by an intruder. Similarly, apparatus attaching means 66 is also isolated from tampering by an intruder.

FIG. 6 shows an enlarged right side perspective view of door strike plate 48. It is comprised of door strike back 54, door strike base 56, and door strike face 58. In door strike face 58 is the door strike aperture 50, which cooperates with pivoting lock dog 60 as illustrated in FIG. 5 when the door security apparatus of the invention is in its locked position as illustrated in FIGS. 2 and 5. Door strike fastening means 52 are also shown, and may be of conventional screws since access to door strike plate 48 is prevented when the apparatus is in its locked position as hereinabove described. Alternatively, door strike plate 48 may be welded to the surface of a metal door if desired, particularly if installation of the fixed clamshell is also done by welding as an alternative installation technique described in regard to FIG. 7.

Turning finally to FIG. 7, a rear perspective view is shown of door security apparatus 10 immediately preceding its installation. Of particular visibility is fixed back 70 showing a plurality of apparatus attaching apertures 74 in two different configurations. The larger ones are intended to facilitate welding of fixed back 70 to a metal door frame or wall if that is the desired installation technique. The smaller ones are intended to allow penetration of an apparatus attaching means 66 such as illustrated in regard to FIGS. 4 and 5. Also seen is the rear of lock dog lip 62 which preferably is a U-shaped cut in fixed back 70 the extremity of which is bent inward to provide a surface on which pivoting lock dog 60 can rest as shown in FIG. 4. This is only utilized when a device is in its opened position, and need be only of minimum structural strength and of no particular construction so long as the objective of retaining the pivoting clamshell portion of the invention in the raised position is accomplished. The raised position of pivoting clamshell 28 is shown in phantom in FIG. 7, but immediately prior to installation pivoting clamshell 28 is allowed to hang vertically downward to permit temporary access to the interior of fixed clamshell 26 for installation purposes utilizing apparatus attaching apertures 74. Installation of door security apparatus 10 is therefore made extremely simple because the device is shipped completely assembled from the manufacturer and requires only attachment, first, of fixed clamshell 26 to the wall or door frame and, second, attachment of door strike plate 48 after pivoting clamshell 28 is raised into the closed or phantom position shown in FIG. 7. Thus, only two simply installation steps are required and no assembly at all is required. Notwithstanding only the two step installation process, the inventive apparatus is completely self contained and extremely tamper resistant.

Although various alternative materials are available for the construction of the inventive door security apparatus, the preferred material is heavy gauge steel sheet metal which is susceptible of automated welding fabrication techniques for the interconnection of such portions as fixed back 70, fixed plate 34, fixed end 38, front 36, and piano hinge 30, and similarly pivoting plate 40, pivoting end 32, and piano hinge 30.

Returning to an overview of the device, it will be seen that the design and construction of door security apparatus 10 provides an inherent shield against rain or precipitation against door periphery 72, particularly seen in FIG. 3, when the device is in its locked position. That is, the apparatus completely shields door periphery 72 from the elements when the same is locked. It also provides substantial protection regarding same even when unlocked. It will also be seen that the apparatus provides a decorative aspect in the form of a small awning across the upper face of a door. This feature can also be enhanced for informational purposes by painting the exterior of the apparatus in various colors which may be keyed for informational purposes, and front 36 has an excellent surface to which informational indicia may be attached as shown at 76 in FIG. 1. As example would be the use of tracks applied to front 36 in which could be inserted letters of the name of the owner of the contents in a storage facility such as shown at 76 in FIG. 1.

Having described the presently preferred embodiments of the invention, it should be understood that various changes in construction and arrangement will be apparent to those skilled in the art and fully contemplated herein without departing from the true spirit of invention. Accordingly, there is covered all alternatives, modifications and equivalents as may be included within the spirit and scope of the invention as defined in the appended claims.

I claim:

1. A door security apparatus for use with a door and a wall in which the door is disposed comprising:

a fixed clamshell for attachment to the wall as a first part of a clamshell enclosure having a plate, fixed ends at both extremities of the plate, a back, and a front, each part being attached to adjoining parts;

a pivoting clamshell as a second part of a clamshell enclosure having a pivoting plate and pivoting ends attached at both extremities of the pivoting plate;

a pivoting means disposed between and attached to both the fixed clamshell and the pivoting clamshell;

a door strike plate for attachment to the door; and a locking means penetrating the clamshell enclosure, which locking means cooperates with the door strike plate.

2. The apparatus of claim 1 in which the pivoting means is a piano hinge.

3. The apparatus of claim 2 in which the piano hinge has welded ends to deter removal of a hinge pin.

4. The apparatus of claim 1 which further comprises a door strike face attached to the door strike plate and a slot penetrating the pivoting plate, through which slot the door strike face can pass to enable, within the enclosure, cooperation between the locking means and the door strike plate.

5. The apparatus of claim 4 in which the fixed ends and pivoting ends overlap each other when the locking means and door strike plate cooperate, said overlap to deter interior access to the clamshell enclosure.

6. The apparatus of claim 4 in which the locking means is a lock to which is attached a lock dog to cooperate with the door strike face.

7. The apparatus of claim 6 in which cooperation comprises insertion of the lock dog into a door strike aperture disposed in the door strike face to interlock the door and pivoting clamshell through the locking means and door strike plate.

8. The apparatus of claim 6 which further comprises a lock dog lip attached to the back to provide a rest for retention of the lock dog when the pivoting clamshell is located in an authorized access position.

9. The apparatus of claim 1 in which the pivoting clamshell has linear contact with the door when the door and pivoting clamshell are interlocked by the cooperation between the locking means and the door strike plate.

10. The apparatus of claim 1 which shields a top surface of the door from weather precipitation when the door and pivoting clamshell are interlocked by the cooperation between the locking means and the door strike plate.

11. The apparatus of claim 1 in which the wall includes a door frame to which door frame portion of the wall attachment of the fixed clamshell may be made.

12. The apparatus of claim which further comprises apparatus attaching apertures disposed in the back and apparatus attaching means in communication both with the back and the wall through the apparatus attaching apertures to connect the fixed clamshell to the wall.

13. The apparatus of claim 1 which further comprises informational indicia disposed on the clamshell enclosure.

14. A door security apparatus comprising:

a clamshell enclosure having a fixed portion attached to a wall proximal a door, said fixed portion including a plate, fixed ends attached at both extremities thereof, and a back and a front, each attached to the plate and the fixed ends at adjoining edges thereof;

said clamshell enclosure having a pivoting portion including a pivoting plate and pivoting ends attached at both extremities thereof;

pivoting means in communication with both the pivoting and fixed portions;

a door strike plate attached to he door; and a locking means disposed within the clamshell enclosure for selective engagement with the door strike plate to interlock the door with the door security apparatus.

15. The apparatus of claim 14 in which the pivoting means is a piano hinge.

16. The apparatus of claim 15 in which the piano hinge has welded ends to deter removal of a hinge pin.

17. The apparatus of claim 14 which further comprises a door strike face attached to the door strike plate and a slot penetrating the pivoting plate, through which slot the door strike face can pass to enable, within the enclosure, cooperation causing interlocking between the locking means and the door strike plate.

18. The apparatus of claim 14 in which the fixed ends and pivoting ends overlap each other when the locking means and door strike plate cooperate, said overlap to deter interior access to the clamshell enclosure.

19. The apparatus of claim 17 in which the locking means is a lock to which is attached a lock dog to cooperate with the door strike face.

20. The apparatus of claim 19 in which interlocking results from insertion of the lock dog into a door strike aperture disposed in the door strike face.

21. The apparatus of claim 19 which further comprises a lock dog lip attached to the back to provide a rest for retention of the lock dog when the pivoting clamshell is located in an authorized access position.

22. The apparatus of claim 14 in which the pivoting clamshell has linear contact with the door when the door and pivoting clamshell are interlocked.

23. The apparatus of claim 14 which shields a top surface of the door from weather precipitation when the door and pivoting clamshell are interlocked.

24. The apparatus of claim 14 in which the wall includes a door frame to which door frame portion of the wall attachment of the fixed clamshell may be made.

25. The apparatus of claim 14 which further comprises apparatus attaching apertures disposed in the back and apparatus attaching means in communication both with the back and the wall through the apparatus attaching apertures to connect the fixed clamshell to the wall.

26. The apparatus of claim 14 which further comprises informational indicia disposed on the clamshell enclosure.

* * * * *